US009931848B2

(12) United States Patent
Mueller et al.

(10) Patent No.: US 9,931,848 B2
(45) Date of Patent: Apr. 3, 2018

(54) DIGITAL PRINTING MACHINE

(71) Applicant: HEIDELBERGER DRUCKMASCHINEN AG, Heidelberg (DE)

(72) Inventors: Andreas Mueller, Heidelberg (DE); Jochen Renner, Edingen-Neckarhausen (DE); Matthias Zapf, Heidelberg (DE); Ralf Steinmetz, Bammental (DE); Michael Oestreicher, Eppelheim (DE); Burkhard Wolf, Dossenheim (DE); Manfred Haeussler, Karlsruhe (DE); David Ehrbar, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/382,933

(22) Filed: Dec. 19, 2016

(65) Prior Publication Data

US 2017/0173959 A1 Jun. 22, 2017

(30) Foreign Application Priority Data

Dec. 21, 2015 (DE) ..... 10 2015 226 234

(51) Int. Cl.
*B41J 2/165* (2006.01)
*B41J 25/304* (2006.01)

(52) U.S. Cl.
CPC ..... *B41J 2/16511* (2013.01); *B41J 2/16505* (2013.01); *B41J 25/304* (2013.01)

(58) Field of Classification Search
CPC .... B41J 2/165; B41J 2/16505; B41J 2/16511; B41J 2/16517; B41J 2/16523; B41J 2/16552; B41J 3/543
See application file for complete search history.

(56) References Cited

U.S. PATENT DOCUMENTS 4,967,204 A * 10/1990 Terasawa ..... B41J 2/1652 347/23
5,670,997 A * 9/1997 Sugimoto ..... B41J 2/16508 347/30
5,896,143 A * 4/1999 Matsui ..... B41J 2/16508 347/24
6,209,983 B1 4/2001 Osborne et al.
6,830,311 B2 * 12/2004 Fukasawa ..... B41J 2/16511 347/23

(Continued)

FOREIGN PATENT DOCUMENTS

CA 2588637 A1 6/2006
DE 19531352 A1 8/1996

(Continued)

*Primary Examiner* — Anh T. N. Vo
(74) *Attorney, Agent, or Firm* — Laurence A. Greenberg; Werner H. Stemer; Ralph E. Locher

(57) ABSTRACT

A digital printing machine includes a printing material transport device, an inkjet print head having a nozzle plate, and a capping element. The inkjet print head is adjustable into a first print head position relative to the capping element and the capping element is adjustable into a capping position relative to the inkjet print head. The capping element temporarily covers the nozzle plate when the inkjet print head is in the first print head position and the capping element is simultaneously in the capping position.

9 Claims, 5 Drawing Sheets

(56) References Cited

U.S. PATENT DOCUMENTS

| | | | | |
|---|---|---|---|---|
| 6,837,566 | B2 * | 1/2005 | Mitsuzawa | B41J 2/16505 347/23 |
| 6,974,201 | B2 * | 12/2005 | Kanemura | B41J 2/0457 347/14 |
| 8,794,738 | B2 * | 8/2014 | Katoh | B41J 2/16585 347/29 |
| 9,193,164 | B2 * | 11/2015 | Kritchman | B41J 2/16538 |
| 2006/0119653 | A1 | 6/2006 | Berry et al. | |

FOREIGN PATENT DOCUMENTS

| | | | |
|---|---|---|---|
| DE | 102014101860 | A1 | 8/2015 |
| WO | 2006060844 | A1 | 6/2006 |
| WO | 2015185149 | A1 | 12/2015 |

* cited by examiner

DIGITAL PRINTING MACHINE

CROSS-REFERENCE TO RELATED APPLICATION

This application claims the priority, under 35 U.S.C. § 119, of German Patent Application DE 10 2015 226 234.0, filed Dec. 21, 2015; the prior application is herewith incorporated by reference in its entirety.

BACKGROUND OF THE INVENTION

Field of the Invention

The present invention relates to a digital printing machine including a printing material transport device, at least one inkjet print head, and a capping element.

International Publication WO 2006/060844 A1, corresponding to Canadian Patent CA 2 588 637, discloses a digital printing machine with a capping element. The capping element is configured to be adjustable into a first position and into a second position. In the second position, the capping element is in contact with the inkjet print head.

SUMMARY OF THE INVENTION

It is an object of the invention to provide a digital printing machine, which overcomes the disadvantages of the heretofore-known machines of this general type.

With the foregoing and other objects in view there is provided, in accordance with the invention, a digital printing machine comprising a printing material transport device, an inkjet print head having a nozzle plate, and a capping element. The inkjet print head is configured to be adjustable into a first print head position relative to the capping element, the capping element is configured to be adjustable into a capping position relative to the inkjet print head, and the capping element temporarily covers the nozzle plate when the inkjet print head is in the first print head position and the capping element is simultaneously in the capping position.

An advantage of the digital printing machine of the invention is that it has a particularly compact construction. A mechanism for moving the inkjet print head is very simple in structural terms.

In another development, the inkjet print head is configured to be adjustable from a second print head position into the first print head position, wherein the distance between the inkjet print head and the printing material transporting device is greater when the inkjet print head is in the first print head position than when the inkjet print head is in the second print head position.

In a further development the printing material transport device is embodied as a drum or as an endless belt. In the case of a drum, the inkjet print head is configured to be adjustable into the first print head position in a radial direction relative to the drum. In the case of the endless belt alternative, the inkjet print head is configured to be adjustable into the first print head position in a direction perpendicular to the endless belt.

In an added development, the inkjet print head is disposed in a row of print heads together with further inkjet print heads and fixed to a crossbar, wherein the crossbar is configured to be adjustable and wherein the inkjet print head is adjustable into the first print head position together with the further inkjet print heads by an adjustment of the crossbar, and wherein the capping element is embodied as a common capping element for temporarily covering the nozzle plate of the inkjet print head and of nozzle plates of the further inkjet print heads or as a common capping element for temporarily covering a common nozzle plate of the inkjet print head and of the further inkjet print heads.

In an additional development the crossbar is configured to be adjustable in such a way as to have only a single degree of freedom of movement.

In yet another development the capping element is configured to be adjustable from a passive position into the capping position and the capping element is a trough filled with a fluid that forms a fluid surface.

In yet a further development the capping element is oriented to be horizontal or tangential to the printing material transport device in the passive position and oriented to be vertical or radial relative to the printing material transport device in the capping position. The tangential and radial orientations refer to the aforementioned embodiment of the printing material transport device as a drum.

In again a further development, the trough has an inner profile that causes the fluid surface to have a greater surface area when the capping element is in the capping position than when the capping element is in the passive position.

In still another development the inner profile is a hook profile.

In a concomitant development the inkjet print head, the further inkjet print heads, the capping element, and the crossbar jointly form a printing unit. This printing unit and further printing units of this kind are disposed along the printing material transport device in a straight or arcuate printing unit row. The configuration in an arcuate printing unit row refers to the aforementioned embodiment of the printing material transport device as a drum, wherein the printing unit row extends along the circumference of the drum.

Other features which are considered as characteristic for the invention are set forth in the appended claims.

Although the invention is illustrated and described herein as embodied in a digital printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
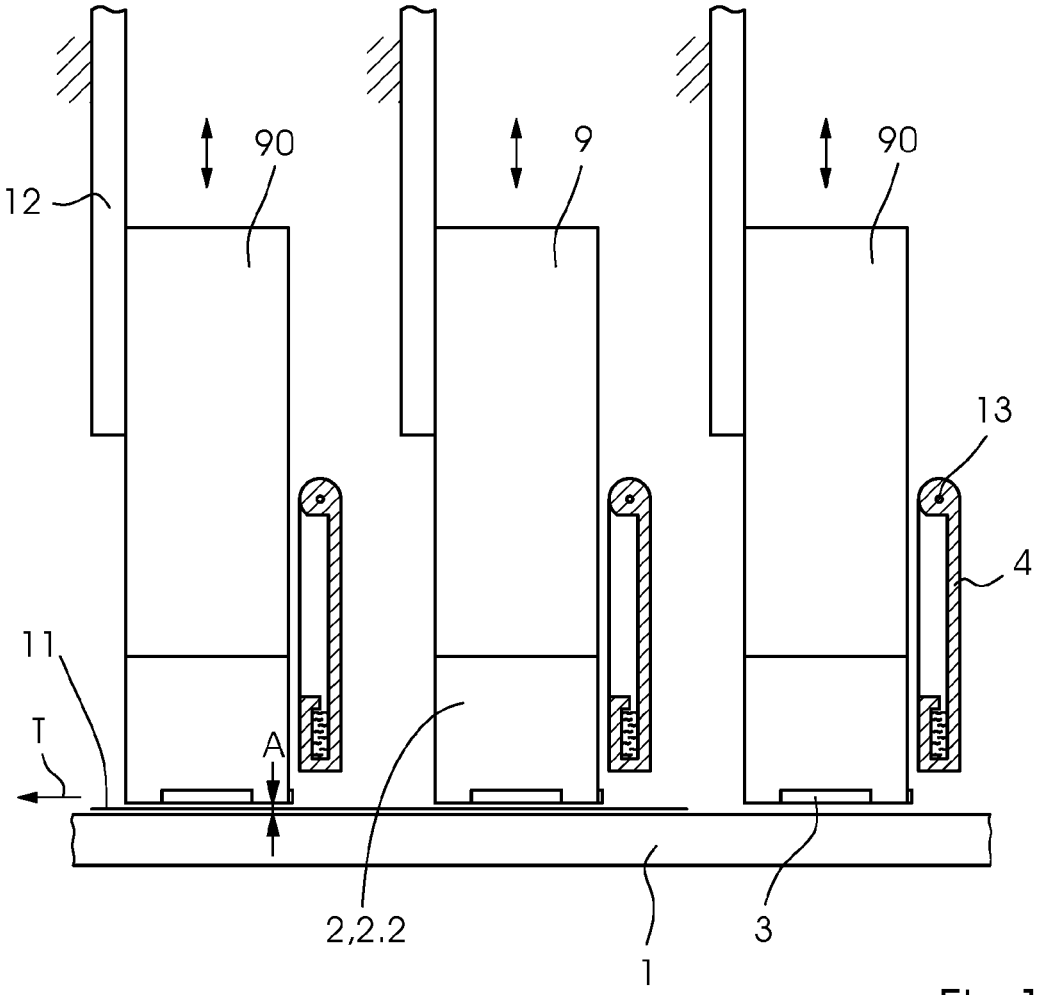
FIG. 1 is a fragmentary, diagrammatic, side-elevational view of a digital printing machine with inkjet print heads that have been lowered.

Referring now in detail to the figures of the drawings, in which mutually corresponding elements have identical reference numerals, and first, particularly, to FIG. 1 thereof, there is seen a digital printing machine including a plurality of printing units 9, 90. The printing units 9, 90 may be referred to as printing bars. The printing units 9, 90 successively print different colors onto printing material 11. The printing material 11 is a sheet that is transported in a direction of transport T past the printing units 9, 90 by using a printing material transport device 1. The printing units 9, 90 form a row 10 of printing units that is parallel to the direction of transport T (see FIG. 5). The printing material transport device 1 is a revolving endless belt holding the printing material 11 by a vacuum. Every printing unit 9, 90 is movable along a vertical linear guide 12. A capping element 4 that is pivotable about a joint 13 is disposed next to every printing unit 9, 90. Every printing unit 9, 90 includes inkjet print heads 2, 20 disposed in a row 5 of print heads perpendicular to the direction of transport T (see FIG. 4). Every inkjet print head 2, 20 has a nozzle plate 3 including nozzles for expelling ink. Every printing unit 9, 90 is selectively movable along its vertical linear guide 12 to move the inkjet print heads 2, 20 into a first print head position 2.1 and into a second print head position 2.2.

Figure 2:
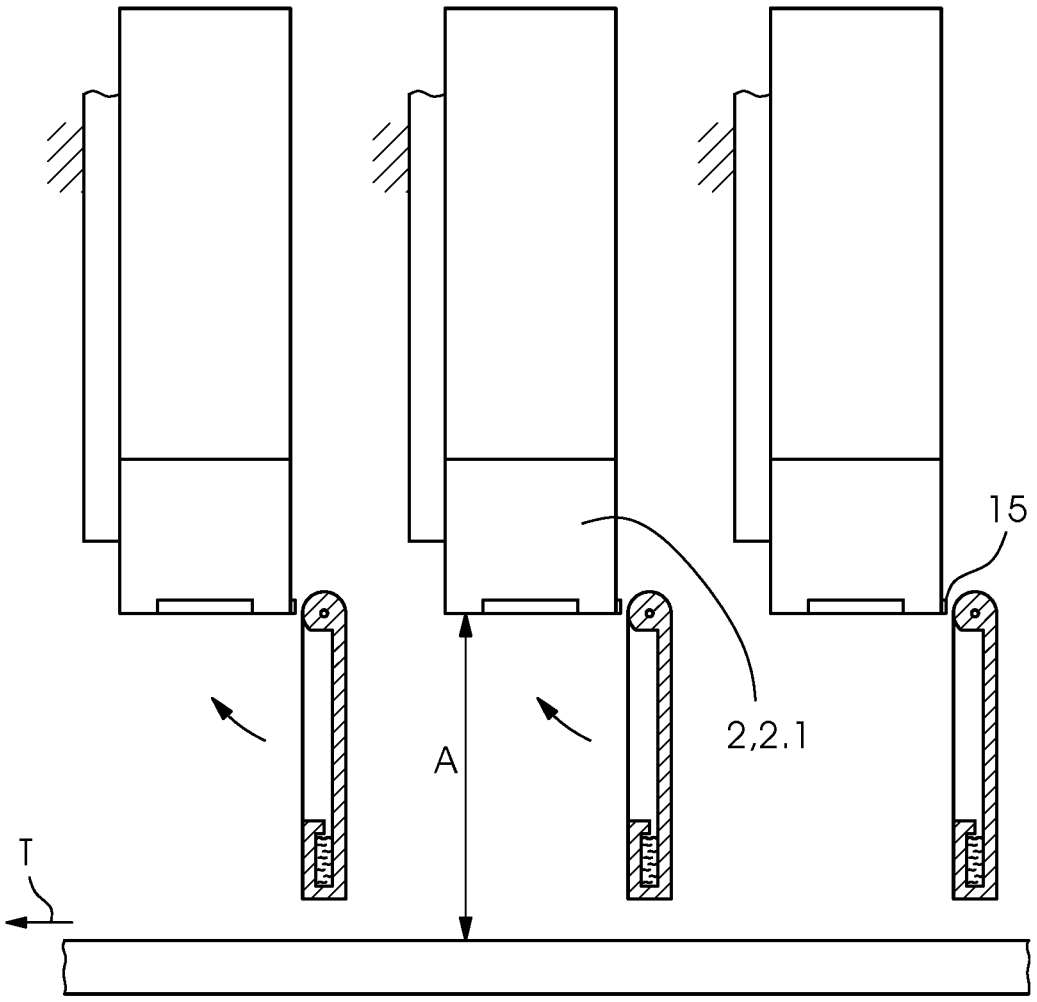
FIG. 2 is a side-elevational view of a digital printing machine with inkjet print heads that have been lifted.

In FIG. 2, all of the printing units 9, 90 have been moved to an upper position, i.e. all of the inkjet print heads 2, 20 are in the first print head position 2.1. In FIG. 1, all of the printing units 9, 90 have been moved to a lower position, i.e. all of the inkjet print heads are in the second print head position 2.2. A distance A between the nozzle plate 3 of the respective inkjet print head 2, 20 and the printing material transport device 1 is greater in the first print head position 2.1 than in the second print head position 2.2. The first print head position 2.1 is provided for covering (capping) the nozzle plates 3 of the inkjet print heads 2, 20 of the respective printing unit 9, 90. In the second print head position 2.2, the printing units 9, 90 print on the printing material 11.

Figure 3:
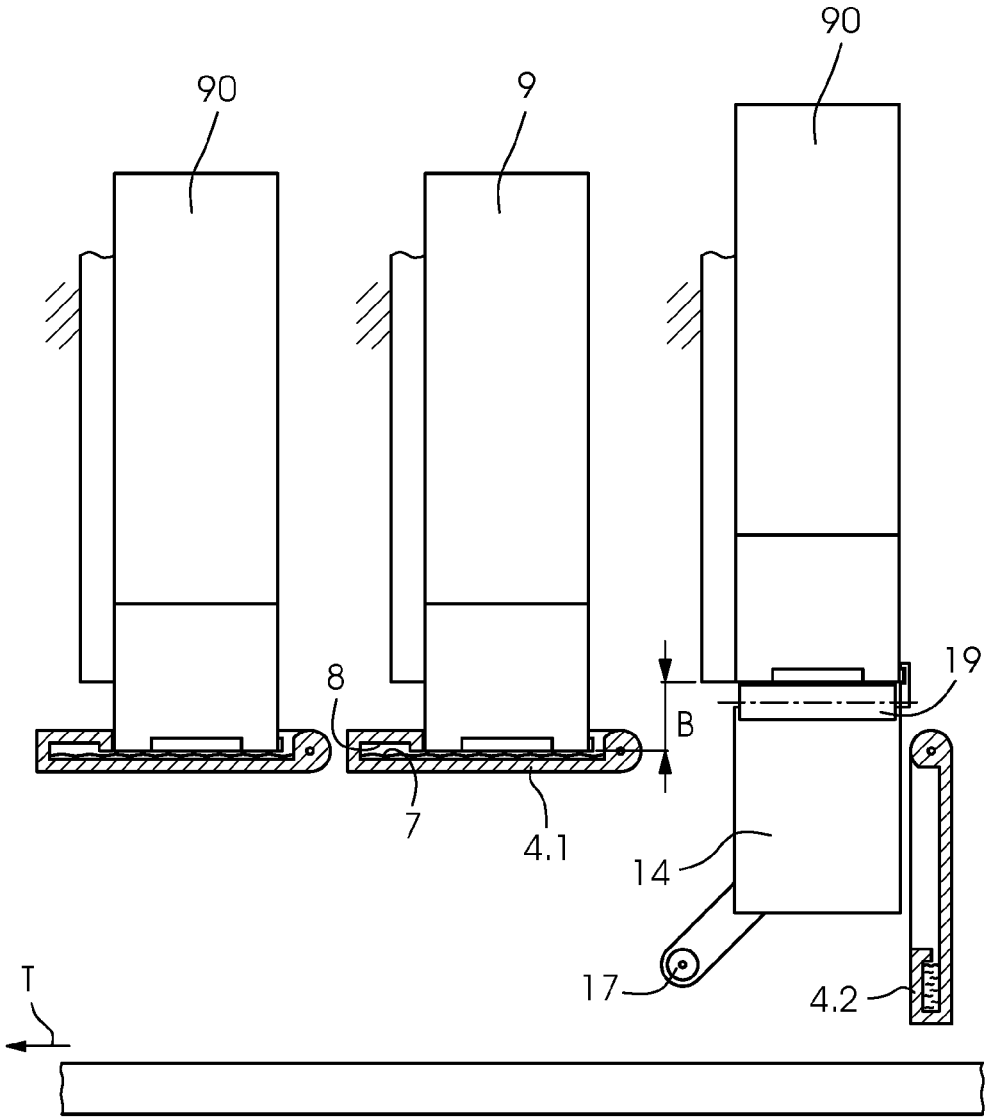
FIG. 3 is a side-elevational view illustrating the digital printing machine during an inkjet print head cleaning process.

FIG. 3 illustrates the associated capping elements 4 covering the inkjet print heads 2, 20 of the middle printing unit 9 and of the left-hand printing unit 90 to protect the nozzles against drying out and becoming blocked during an interruption of the printing operation. Each respective capping element 4 is a common capping element for covering the nozzle plates 3 of all of the inkjet print heads 2, 20 of the respective printing unit 9, 90. When they are covered, the middle and left-hand printing units 9, 90 are in the first print head position 2.1. The right-hand printing unit 90 has been moved upward through a distance B beyond the first print head position 2.1 into a position for cleaning the nozzle plates 3. The capping elements 4 of the middle and left-hand printing units 9, 90 have been pivoted upward into a horizontally-oriented capping position 4.1, while the capping element 4 of the right-hand printing unit 90 has been pivoted downward into a vertically-oriented passive position 4.2. Every capping element 4 is embodied as a trough filled with a fluid that forms a fluid surface 7. The interior of every capping element 4 has a hook-shaped profile 8 enclosing a fluid chamber on three sides. The hook profile 8 includes a side wall of the capping element 4. In the passive position 4.2, the entire fluid stored in the capping element 4 is located in the fluid chamber and the fluid only covers a section of a bottom of the capping element 4. The size of the surface area of the fluid surface 7 is defined by the size of the surface of the side wall, which is covered by the fluid in its entirety. In the capping position 4.1, the fluid only covers a section of the side wall, but the entire bottom of the capping element 4 and the size of the surface of the fluid level 7 is defined by the size of the surface of the bottom. The bottom has a greater surface area than the side wall of the capping element 4. In the capping position 4.1, a lot of the fluid may evaporate from the large fluid surface 7, creating a humid atmosphere between the fluid surface 7 and the nozzle plate 3 that is to be kept humid. In the passive position 4.2, the small fluid surface 7 allows only little fluid to evaporate, keeping fluid losses to the environment low and saving fluid.

Figure 4:
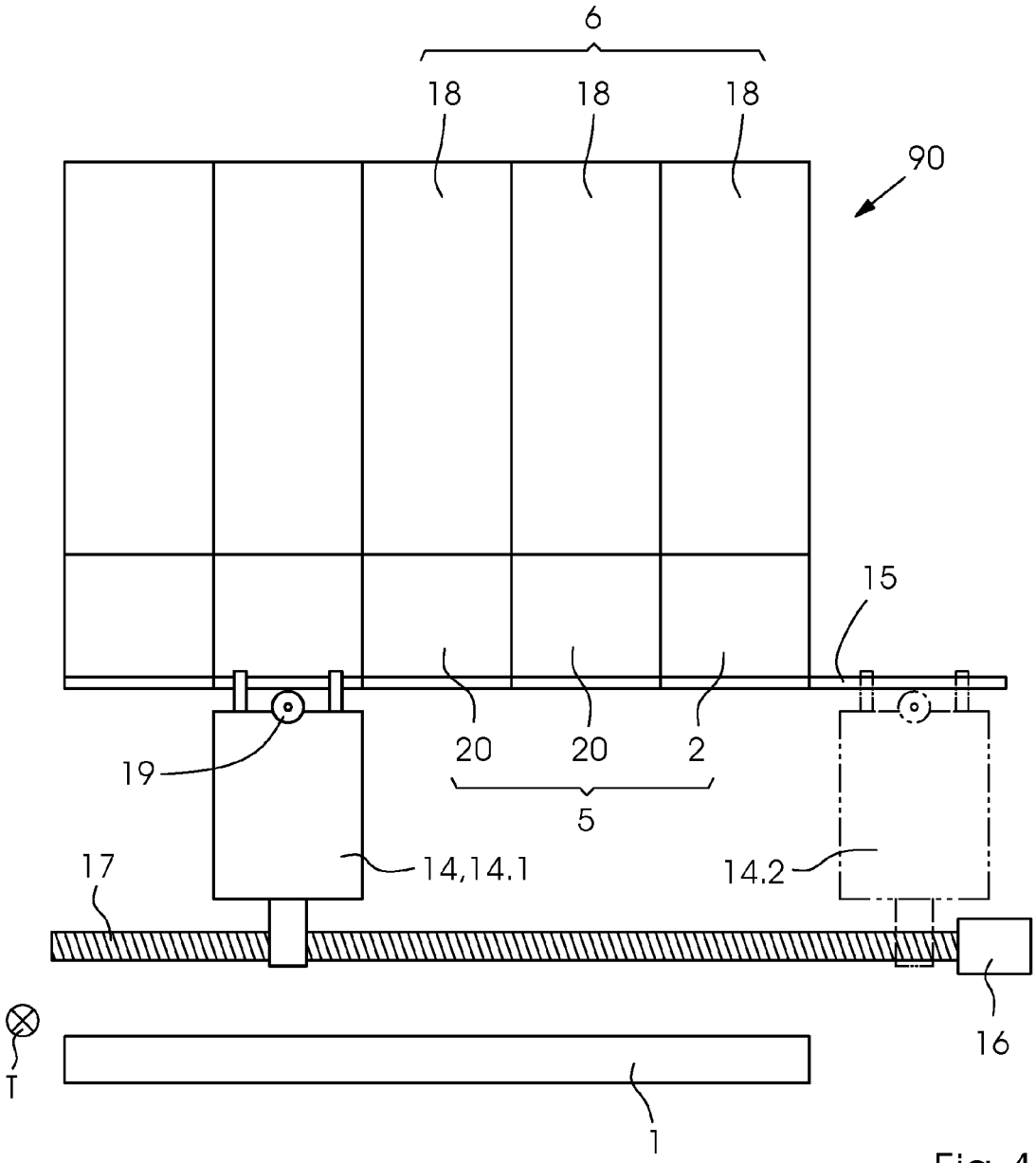
FIG. 4 is a front-elevational view illustrating the inkjet print head cleaning process.

FIG. 4 illustrates the construction of the printing units 9, 90 based on the right-hand printing unit 90 of FIG. 3 by way of example. The printing unit 90 includes a row of seats 18 for the inkjet print heads 2, 20. The seats 18 are interconnected and together, they form a crossbar 6. Every seat 18 is provided to receive and hold another inkjet print head 2, 20. The printing unit 90 is a so-called page-width printing unit, i.e. it extends over the entire width to be printed on the printing material 11. In accordance with the perspective on which FIG. 4 is based, the direction of transport T is perpendicular to the plane of the image of FIG. 4. In FIG. 4, the printing material 11 and the capping element 4 are not shown for reasons of clarity. A horizontal linear guide 15 that extends in a direction parallel to the crossbar 6 is disposed on the printing unit 90. The horizontal linear guide 15 may be composed of track elements, each of which is a part of a different inkjet print head 2, 20. The horizontal linear guide 15 guides a cleaning device 14 along the row of inkjet print heads 2, 20 to clean the nozzle plates 3 thereof. The movement of the cleaning device 14 is driven by a motor 16 through a threaded spindle 17. The cleaning device 14 may be moved from a park position 14.2, in which it is not located opposite the inkjet print heads 2, 20, into various cleaning positions 14.1. In every cleaning position 14.1, the cleaning device 14 is located opposite a different one of the inkjet print heads 2, 20 to clean ink residue and paper dust off the nozzle plate 3 of the respective inkjet print head 2, 20 by using a cleaning element 19. The cleaning element 19 may be a pad or a roller made of felt or any other type of soft, absorbent material.

Figure 5:
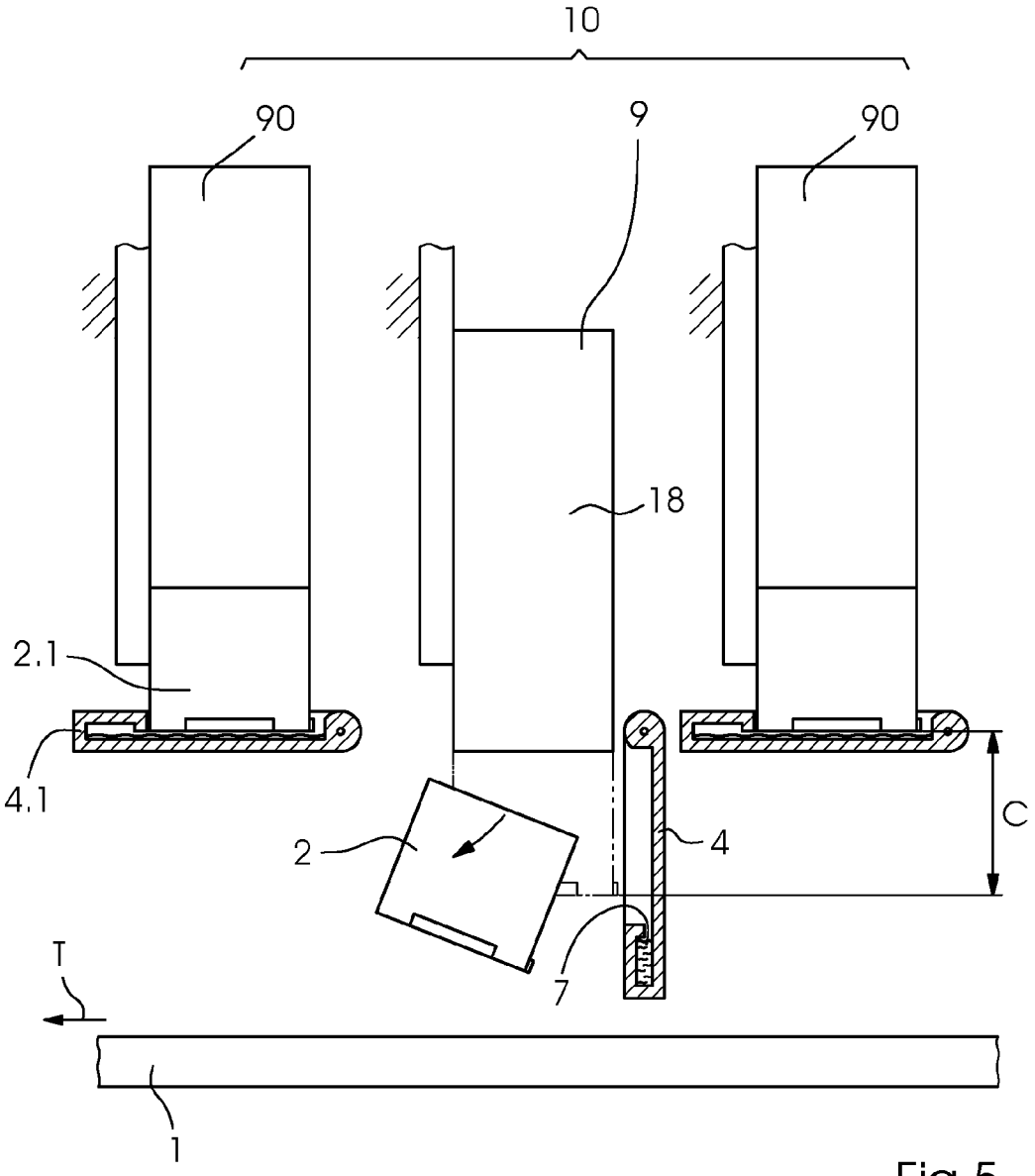
FIG. 5 is a side-elevational view illustrating the digital printing machine in a print head change process.

FIG. 5 illustrates a situation or setting in which the two outer printing units 90 are in their respective first print head positions 2.1 and the capping elements 4 are closed. The middle printing unit 9 has been moved into a change position for changing a defective inkjet print head 2 and its capping element 4 has been opened. The change position is lower than the first print head position 2.1 by a distance C, i.e. it is an intermediate position between the first print head position 2.1 and the second print head position 2.2. The defective inkjet print head 2 is shown to be released from its seat 18. The removal and subsequent reattachment may be carried out by an operator because the seat 18 and the inkjet print head 2 may be coupled through a quick-change device.

An advantage of the invention is the compact construction of the digital printing machine. This is achieved by the fact that the capping elements are always located above the printing material transport path as defined by the printing material transport device 1. Through the use of the joints 13, the capping elements 4 may be fixed directly to the machine frame in such a way as to be stationary. Neither a lateral movement of the printing unit 9, 90 nor a lateral movement of the capping elements 4 is required to move the capping elements 4 into the capping position 4.1 to cover the nozzle plates 3. In this context, "lateral" is understood to be a direction of movement corresponding to that of the cleaning device 14 (see FIG. 4). Tracks that protrude from the machine on the sides to move the printing units 9, 90 are not required.

An additional advantage of the invention is that the mechanism for adjusting the printing units 9, 90 may have a simple construction because no lateral movement of the printing units 9, 90 is required. The mechanisms may be embodied as the vertical guide 12 and may be combined with drives. Each respective vertical linear guide 12 provides a single degree of freedom for the movement of the respective crossbar 6.

The invention claimed is:

1. A digital printing machine, comprising:

a transport device for printing material;

an inkjet print head for printing on the printing material, said inkjet print head having a nozzle plate; and a capping element;

said inkjet print head being adjustable into a first print head position relative to said capping element;

said capping element being adjustable from a passive position into a capping position relative to said inkjet print head;

said capping element being a trough filled with a fluid forming a fluid surface, said trough having an inner profile causing said fluid surface to have a greater surface area when said capping element is in said capping position than when said capping element is in said passive position;

said capping element having a bottom, said fluid only partially covering said bottom in said passive position and said fluid entirely covering said bottom in said capping position; and said capping element temporarily covering said nozzle plate when said inkjet print head is in said first print head position and said capping element is simultaneously in said capping position.

2. The digital printing machine according to claim 1, wherein:

said inkjet print head is adjustable from a second print head position into said first print head position; and said inkjet print head and said printing material transporting device are spaced apart by a distance being greater when said inkjet print head is in said first print head position than when said inkjet print head is in said second print head position.

3. The digital printing machine according to claim 1, wherein said printing material transport device is a drum, and said inkjet print head is adjustable into said first print head position in a radial direction relative to said drum.

4. The digital printing machine according to claim 1, wherein said printing material transport device is an endless belt, and said inkjet print head is adjustable into said first print head position in a direction perpendicular to said endless belt.

5. The digital printing machine according to claim 1, wherein:

said inkjet print head is disposed in a row of print heads together with further inkjet print heads being fixed to a crossbar;

said crossbar is adjustable and said inkjet print head is adjustable into said first print head position together with said further inkjet print heads by an adjustment of said crossbar; and said capping element is a common capping element for temporarily covering said nozzle plate of said inkjet print head and said nozzle plates of said further inkjet print heads or for temporarily covering a common nozzle plate of said inkjet print head and of said further inkjet print heads.

6. The digital printing machine according to claim 5, wherein said crossbar is adjustable in only a single degree of freedom of movement.

7. The digital printing machine according to claim 5, wherein:

said inkjet print head, said further inkjet print heads, said capping element, and said crossbar together form a printing unit; and said printing unit, together with said further printing units, is disposed along said printing material transport device in a straight or arcuate row of printing units.

8. The digital printing machine according to claim 1, wherein:

said capping element is oriented horizontally or tangentially relative to said printing material transport device in said passive position; and said capping element is oriented vertically or radially relative to said printing material transport device in said capping position.

9. The digital printing machine according to claim 1, wherein said inner profile is a hook profile.

* * * * *